US005447260A

United States Patent [19]

Beddow

[11] Patent Number: 5,447,260

[45] Date of Patent: Sep. 5, 1995

[54] DRAW STRING PULLER

[76] Inventor: Randall E. Beddow, 1415 Eagle Park Rd. #128, Hacienda Heights, Calif. 91745

[21] Appl. No.: 129,423

[22] Filed: Sep. 30, 1993

[51] Int. Cl.[6] ..... A41H 43/00

[52] U.S. Cl. ..... 223/50; 223/105

[58] Field of Search ..... 223/50, 99, 102, 103, 223/105; 174/87

[56] References Cited

U.S. PATENT DOCUMENTS

| | | | |
|---|---|---|---|
| 535,108 | 3/1895 | Helgesson | 223/103 |
| 609,712 | 8/1898 | Thompson | 223/103 |
| 2,491,776 | 12/1949 | Skelton | 223/105 |
| 2,541,293 | 2/1951 | Robison | 223/105 |

FOREIGN PATENT DOCUMENTS

| | | | |
|---|---|---|---|
| 755332 | 8/1956 | United Kingdom | 223/105 |

*Primary Examiner*—Clifford D. Crowder
*Assistant Examiner*—Bibhu Mohanty
*Attorney, Agent, or Firm*—Robert R. Meads

[57] ABSTRACT

A longitudinally elongated, transversely flexible pulling member, having a rounded leading end and a trailing end with a female connector for releasably capturing a leading tip end of a drawstring, whereby the leading end of the pulling member can be inserted into an entry end of a drawstring channel in a garment or container and pushed there along to pull the drawstring into and along the channel to insert the drawstring in the channel with opposite ends of the drawstring extending from opposite ends of the channel.

9 Claims, 1 Drawing Sheet

DRAW STRING PULLER

FIELD OF INVENTION

The present invention generally relates to an accessory tool for inserting and or replacing drawstrings as used in clothing and drawstring-closed containers, specifically for such items as sweat pants, hooded apparel, swimming trunks, duffle bags, etc.

BACKGROUND

The fit of a garment is frequently controlled by the use of a drawstring. Similarly, a container may use a drawstring as a closure device. A drawstring typically is of sufficient length to extend through and be contained in a drawstring channel formed in the garment or container along a marginal edge of an adjustable opening. Opposite ends of the drawstring extend beyond opposite ends of the drawstring channel for adjustment by the user.

The tip ends of a drawstring are often unfinished and subject to fraying. Conversely, it is common that opposite end portions of a drawstring be enclosed in short cylindrical plastic sleeves to prevent fraying of the tip ends and to facilitate handling particularly during insertion of the drawstring into a drawstring channel.

In many garments and containers, the entry and exit ends of the drawstring channel include eyelets forming rigid annular openings sized to pass the drawstring and its tip ends. The eyelets function to reduce damage to the garment or container adjacent the ends of the drawstring channel caused by longitudinal movement of the drawstring within the channel.

In the past, "pusher" devices have been used to insert drawstrings into drawstring channels. Such pusher devices require an end portion of a drawstring to be folded over a leading end of the pusher while the pusher device forces the drawstring through an end opening of the drawstring channel, then through the channel and out an opposite end opening of the channel. In some applications, a cap is placed over the leading end of the pusher and the fold of the drawstring. The cap provides additional retention of the drawstring to the pusher during the insertion through the drawstring channel and helps reduce the likelihood of damage to the channel material during the passage of the leading end through the channel. The cap also increases the size of the leading end of the pusher. Such increased size of the folded drawstring and the pusher, with or without the retainer cap, may either prevent the pusher from being used with eyelets and drawstring channels sized to the drawstring, or may require that the entry and exit eyelets and the channel be considerably larger than the drawstring to permit the use of the pusher. Any increase in the size of the drawstring channel and eyelets requires additional material to be used in the garment or container, and thereby increases the bulk and cost of the garment or container.

In the home, it may be desirable to remove a drawstring from a garment for washing to prevent the drawstring from being lost in the washer or causing damage by entanglement in the washer mechanism. After washing, the drawstring is reinserted in the drawstring channel. As a drawstring wears, it may be desired to replace the worn drawstring. Also, for fashion purposes, it may be desired to replace a drawstring with a drawstring of a different color or pattern. Replacing and reinserting a drawstring to meet these conditions is frequently accomplished by the use of a "safety pin" attached to an end of the drawstring and manually guided and pushed through the eyelets and the drawstring channel. This method is slow and laborious and involves the risk of injury if the pin opens unobserved within the channel, exposing the sharp end of the pin to injurious contact with the user. Certainly, such a method of drawstring replacement is not convenient when the garment is being worn.

The present invention overcomes the aforementioned disadvantages and provides a convenient to use and inexpensive "puller" for manually replacing and reinserting a drawstring into and through a drawstring channel. With the puller of the present invention, a drawstring may be quickly and easily removed and replaced even when the garment is being worn. Further, with the puller of the present invention, eyelets and drawstring channel sizes may be tailored to the drawstring instead of the drawstring insertion device without increasing the cost or likelihood of damage to the associated garment or container.

SUMMARY OF INVENTION

The present invention comprises a longitudinally elongated laterally flexible drawstring pulling member ("puller"). Preferably, the puller takes the form of a thin flexible rod including a rounded leading end and a trailing end with a female connector for releasably capturing a leading tip end of a drawstring. The rod sectional dimension is only slightly greater than the diameter of the leading tip end of the drawstring. This permits the leading end of the rod to freely pass through an inlet eyelet of a drawstring channel, then through channel and out an exit eyelet. Upon reaching the exit eyelet, the rod is axially pulled to pull a drawstring attached to the trailing end through the drawstring channel until the puller has exited the channel and opposite ends of the drawstring extend from opposite ends of the drawstring channel. At that time, the drawstring is released from the puller by disconnecting the leading end of the drawstring from the female connector. Preferably, the connection and release of the drawstring to and from the puller is accomplished by a simple turning of the leading end of the drawstring within the female connector in a first direction for connection and a simple turning of the leading end in an opposite direction for release.

DESCRIPTION OF PREFERRED EMBODIMENTS

Figure 1:
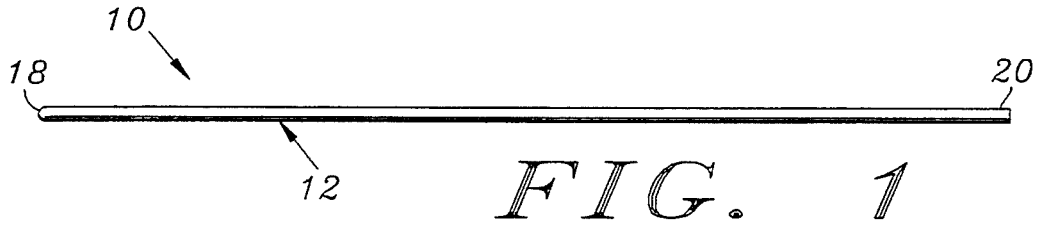
FIG. 1 is a side view of the puller of the present invention.

The present invention may take any of a multiplicity of forms within the scope of the claims hereafter presented. One preferred embodiment is shown in FIG. 1 as comprising a longitudinally elongated, transversely flexible pulling member or puller 10. Preferably, the puller 10 comprises a flexible plastic or metal rod 12 having a diameter slightly larger than the outer diameter of a leading tip end 14 of a drawstring 16, see FIG. 3. Typically the rod 12 is about 10 millimeters in diameter. The length of the rod 12 is suited to the length of the drawstring channel (not shown) into which the drawstring 16 is to be inserted; typically 1 meter in length.

As previously noted, the drawstring channel may include entry and exit eyelets. As shown, the rod 12 has a rounded leading end 18 for ease of entry and travel through the drawstring channel and the eyelets without sharp edges to catch on the material comprising the drawstring channel or the eyelets.

Figure 2:
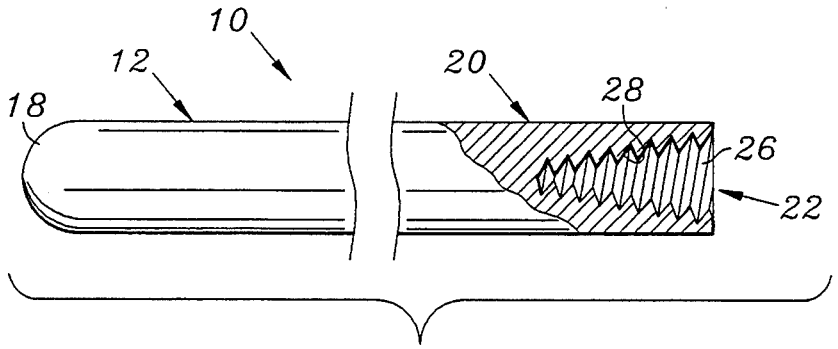
FIG. 2 is an enlarged fragmentary side view partially in section of the puller of FIG. 1 showing the rounded leading end of the puller and one embodiment of the female connector included in the trailing end of the puller.
Figure 3:
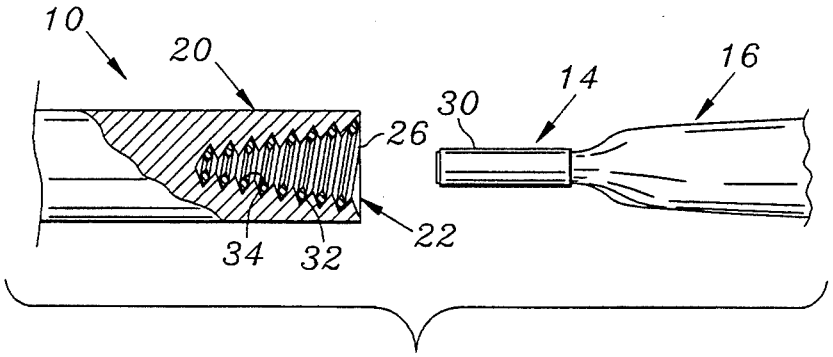
FIG. 3 is an enlarged fragmentary sectional side view of the trailing end of the puller of FIG. 1 showing another embodiment of the female connector comprising a tapered threaded insert in a tapered threaded cavity in the trailing end of the puller ready to releasably receive a leading tip end of a drawstring.
Figure 4:
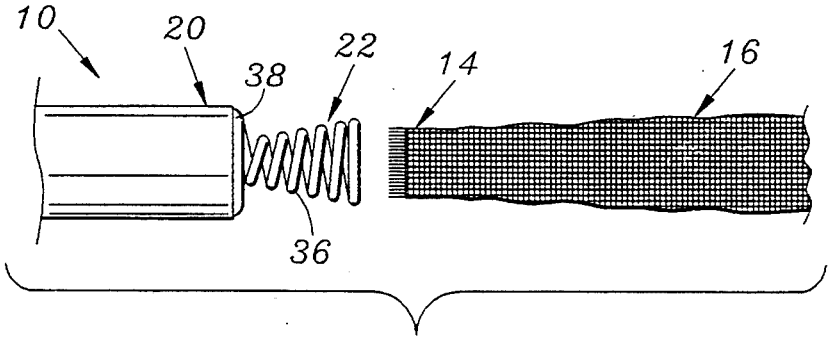
FIG. 4 is a fragmentary sectional side view similar to FIG. 3 showing still another embodiment of the female connector at a trailing end of the puller comprising a tapered spring adhesively attached to the trailing end of the puller for accepting a leading tip end of a drawstring.

As illustrated in FIG. 2, a trailing end 20 of the rod 12 contains or carries a female connector 22 for releasably connecting the leading tip end 14 of the drawstring 16 to the rod (see FIG. 3). The female connector 22 may take a variety of forms. In FIG. 2, the connector 22 is shown as comprising a tapered helically threaded cavity 26 comprising helical and inwardly projecting teeth 28. With respect to the leading tip end 14 of the drawstring 16 shown it FIG. 3, the teeth 28 are designed to grip and releasably secure the leading tip end as it is inserted into the cavity 26 against the teeth 28 and turned in a clockwise direction. As this occurs, the teeth grip an outer surface of either the drawstring material comprising the leading tip end 14 as shown in FIG. 4 or, as shown in FIG. 3, a protective plastic cylinder 30 receiving and seated on the drawstring material forming the leading tip end. Such gripping by the female connector 22 releasably secures the leading tip end 14 of the drawstring 16 to the training end 20 of the rod 12. When it is desired to release the drawstring 16 from the rod 12, as after the rod has pulled the drawstring through the drawstring channel, a simple manual turning of the leading tip end 24 in a counter-clockwise direction relative to the cavity 26 will produce the desired separation of the leading tip end from the cavity.

In FIG. 3, the female connector 22 comprises a stainless steel tapered spring 32 threaded into and fixedly secured within the cavity 26 of FIG. 2. Preferably, the spring 32 is formed of spring metal of diamond-shaped cross section defining inwardly extending helical teeth 34 for releasably gripping the plastic cylinder 30 covering the leading tip end of the drawstring 16 in the manner just described. Thus, the female connector of FIG. 3 functions to releasably connect and disconnect the leading tip end 14 of the drawstring 16 to and from the trailing end 20 of the rod 12 upon a clockwise and counter-clockwise turning respectively of the leading tip end within the cavity formed by the spring 32.

In FIG. 4, the female connector 22 comprises an inwardly tapering helical spring 36 secured at its tapered end 38 to the trailing end 20 of the rod 12 as by adhesive or welding. As shown, the spring 36 is shaped to releasably receive and connect to unfinished drawstring material comprising the leading end of the drawstring 16. With the leading end of the drawstring 16 within the spring 36 and against the tapered end 38, a clockwise turning of the leading end relative to the spring 36 will cause the coils of the spring to grip the drawstring material and connect the drawstring 16 to the rod 12. Conversely, a counter-clockwise turning of the leading end relative to the spring 36, will release the drawstring from the rod.

Thus, as described, in each embodiment of the present invention, the rod 12 releasably captures the leading tip end of the drawstring 16 by (1) insertion of the tip end within the helically inwardly tapered female connector 22 and (2) a clockwise turning of the tip end relative to the connector. Then, in use, the leading end 18 of the rod 12 is inserted into an inlet end of the drawstring channel of a garment or container and pushed through the channel to exit an opposite end thereof. As this occurs, the drawstring 16 connected to the rod is pulled through the drawstring channel until opposite ends of the drawstring extend from opposite ends of the channel. Then, the rod 12 is disconnected from the drawstring 16 by a simple counter-clockwise turning of the leading tip end of the drawstring relative to the rod leaving the drawstring in place within the channel. The rod comprising the puller 10 is then ready for use in inserting or replacing another drawstring as desired.

I claim:

1. A drawstring puller, for inserting a drawstring into a drawstring channel formed in a garment or container to extend along a marginal edge of an adjustable opening with opposite ends of the drawstring extending beyond opposite ends of the drawstring channel, the puller comprising:

a longitudinally elongated, transversely flexible drawstring pulling member about one meter in length and longer than a drawstring channel formed in a garment or container to extend along a marginal edge of an adjustable opening for extending through the drawstring channel with opposite ends exposed;

one of the exposed ends comprising a rounded and smooth leading end on the pulling member for insertion into an entry end of the drawstring channel for movement there along to extend beyond an exit end of the drawstring channel; and helical female connector means at another of the opposite ends comprising a trailing end of the drawstring pulling member exposed to a user when the pulling member extends through the channel for releasably capturing a leading tip end of a drawstring, whereby the trailing end of the pulling member in moving along and within the drawstring channel pulls the drawstring through the drawstring channel between the entry and exit ends of the channel.

2. The puller of claim 1 wherein:

the pulling member comprises a rod; and the female connector means comprises:

a cavity in a trailing end of the rod.

3. The puller of claim 2 wherein the cavity is inwardly tapered and helically threaded.

4. The puller of claim 3 wherein the threads of the cavity form inwardly projecting teeth into which the leading tip end of the drawstring may be inserted and turned in a first direction to connect the leading tip end to the cavity and turned in an opposite direction to disconnect the leading tip end from the cavity.

5. The puller of claim 3 wherein the female connector further comprises an inwardly tapered helically threaded insert in the cavity.

6. The puller of claim 5 wherein the insert is a spring.

7. The puller of claim 1 wherein the female connector comprises an inwardly tapered helical spring having a tapered end attached to a trailing end of the pulling member and an enlarged end for accepting the leading tip end of the drawstring.

8. A method for pulling a drawstring through a drawstring channel in a garment or drawstring closeable container, comprising:

providing a longitudinally elongated, transversely flexible drawstring puller having a smoothly rounded leading end and a helical female connector at a trailing end;

inserting a leading end of a drawstring into the helical female connector at the trailing end of the puller, turning the leading end of the drawstring relative to the puller to lock to the trailing end of the puller, inserting the leading end of the puller into an entry end of the drawstring channel, pushing on the puller to move the puller along the drawstring channel until the leading end of the puller exits an exit opening in the channel, pulling on the leading end of the puller to draw the puller completely through the channel to exit the exit opening, and turning the puller relative to the drawstring to release the leading end of the drawstring from the helical female connector and from the puller.

9. A drawstring puller in combination with a drawstring, comprising:

a drawstring of sufficient length to extend through and be contained in a drawstring channel formed in a garment or container to extend along a marginal edge of an adjustable opening with opposite ends of the drawstring extending beyond opposite ends of the drawstring channel;

a longitudinally elongated, transversely flexible drawstring pulling member about one meter in length and longer than the drawstring channel for extending through the drawstring channel with opposite ends exposed;

one of the exposed ends comprising a rounded and smooth leading end on the pulling member for insertion into an entry end of the drawstring channel for movement there along to extend beyond an exit end of the drawstring channel; and helical female connector means at another of the opposite ends comprising a trailing end of the drawstring pulling member exposed to a user when the pulling member extends through the drawstring channel for releasably capturing a leading tip end of the drawstring, whereby the trailing end of the pulling member in moving along and within the drawstring channel pulls the drawstring through the drawstring channel between the entry and exit ends of the drawstring channel.

* * * * *